US006353396B1

(12) United States Patent
Atlas

(10) Patent No.: US 6,353,396 B1
(45) Date of Patent: Mar. 5, 2002

(54) METHOD AND APPARATUS FOR MONITORING STATES OF CONSCIOUSNESS, DROWSINESS, DISTRESS, AND PERFORMANCE

(75) Inventor: Dan Atlas, Hod Hasharon (IL)

(73) Assignee: Atlas Researches Ltd., Hod Hasharon (IL)

( * ) Notice: Subject to any disclaimer, the term of this patent is extended or adjusted under 35 U.S.C. 154(b) by 0 days.

(21) Appl. No.: 09/715,112

(22) Filed: Nov. 20, 2000

Related U.S. Application Data

(60) Division of application No. 09/339,866, filed on Jun. 25, 1999, now Pat. No. 6,265,978, which is a continuation-in-part of application No. 08/891,445, filed on Jul. 10, 1997, now Pat. No. 5,917,415.

(30) Foreign Application Priority Data

Jul. 14, 1996 (IL) ..... 118854

(51) Int. Cl.[7] ..... G08B 23/00

(52) U.S. Cl. ..... 340/693.9; 340/575; 340/576; 600/384; 600/390

(58) Field of Search ..... 340/693.9, 575, 340/576; 600/390, 386, 682, 684; 374/208

(56) References Cited

U.S. PATENT DOCUMENTS

| | | | | | |
|---|---|---|---|---|---|
| 3,635,213 | A | * | 1/1972 | LaHay | 600/390 X |
| 4,202,344 | A | * | 5/1980 | Mills et al. | 600/390 X |
| 4,296,757 | A | * | 10/1981 | Taylor | 600/534 |
| 4,509,531 | A | * | 4/1985 | Ward | 600/549 |
| 4,586,827 | A | * | 5/1986 | Hirsch et al. | 368/282 |
| 4,638,807 | A | * | 1/1987 | Ryder | 600/390 X |
| 5,115,223 | A | * | 5/1992 | Moody | 340/573.1 |
| 5,670,944 | A | * | 9/1997 | Myllymaki | 340/573.1 |
| 5,917,415 | A | * | 6/1999 | Atlas | 340/575 |
| 5,982,285 | A | * | 11/1999 | Bueche et al. | 340/573.1 |
| 6,081,194 | A | * | 6/2000 | Sanchez | 340/573.1 |

* cited by examiner

*Primary Examiner*—Thomas Mullen

(57) ABSTRACT

Apparatus and method for the early detection of increased performance impairment, incapacitation or drowsiness of a person, particularly of a person gripping an object such as a steering wheel. A wrist band is worn by the person and an electrical sensor is pressed against the person's skin by the band to sense physiological conditions by detecting various parameters at the wrist and analyzing them to provide an indication of the onset of drowsiness in the person. Some of the parameters analyzed include EMG, temperature, response to stimulation and muscular activity at the wrist. A description of a shock-absorbing wrist monitor is disclosed.

8 Claims, 8 Drawing Sheets

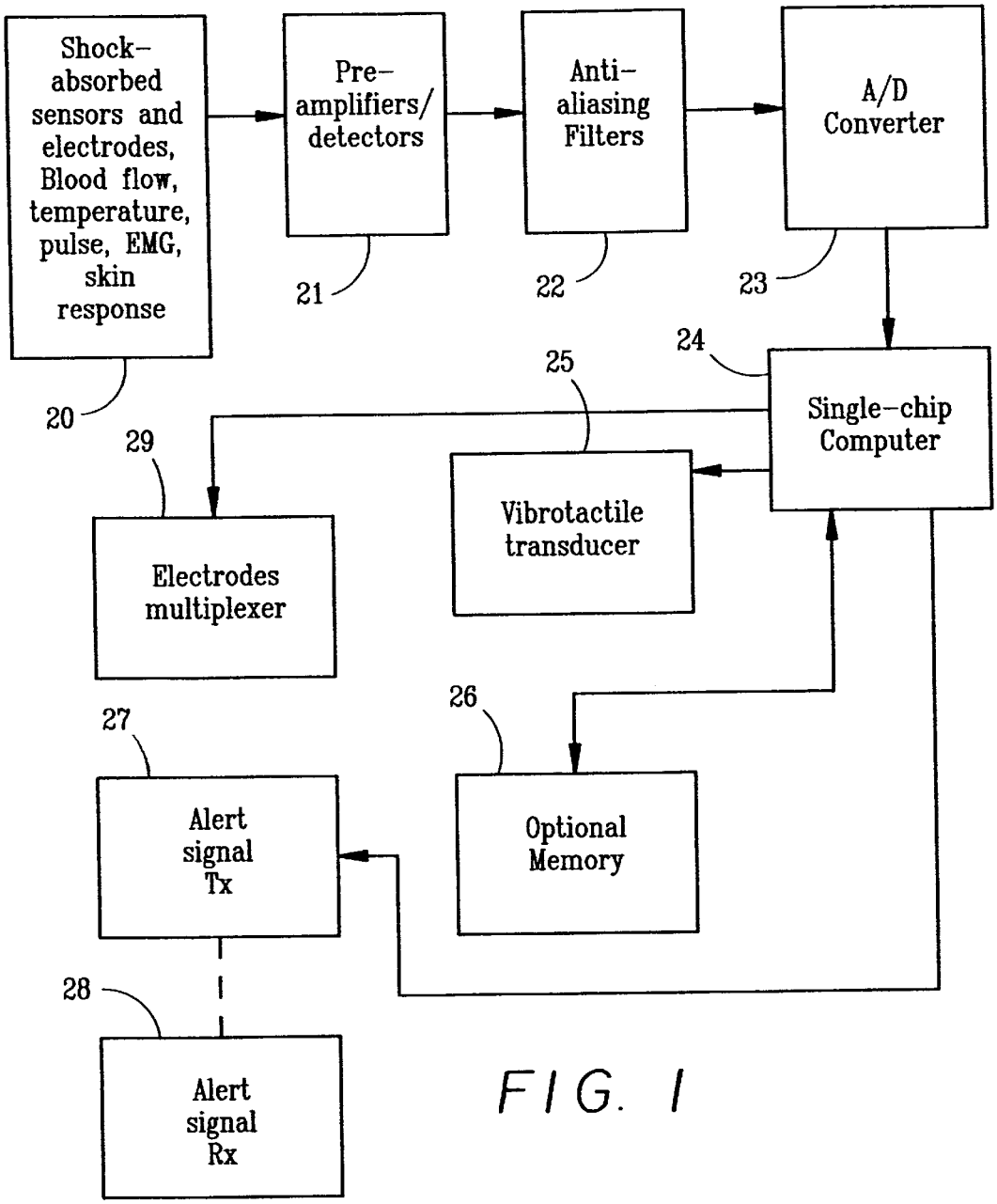
FIG. 1
FIG. 3
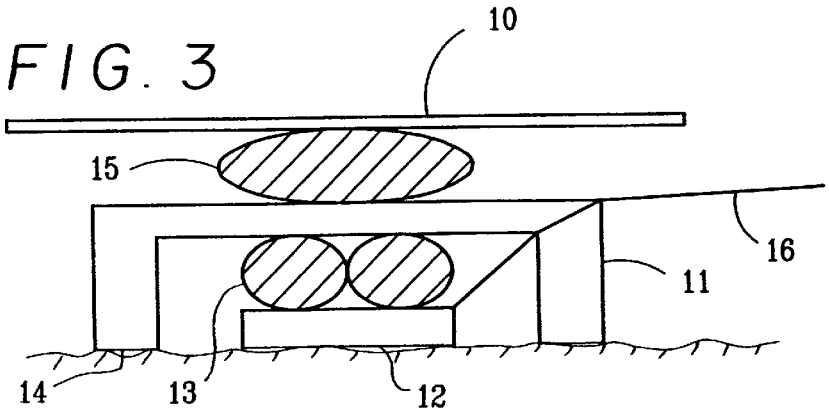

MICRO COMPUTER
142
RF RECEIVER
148
RF TRANSMITTER
143
RF TRANSMITTER
147
RF RECEIVER
144
VEHICLE
ADDRESS
DATA
MULTIPLEXER A/D
141
50KHz CURRENT SOURCE
139
FILTER AMPLIFIER & DEMODULATOR
140
EMG
PULSE
3Hz
TEMP
COMMON
WRIST ELECTRODES
116
111
112
113
THERMAL SENSOR (WRIST)
114
WRIST STIMULATOR
VIBRO TACTILE TRANSDUCER (WRIST)
115
DASH BOARD COMPUTER
145
AUDIO/VIDEO ALARM
149
RS232C
VEHICLE COMPUTER
146

METHOD AND APPARATUS FOR MONITORING STATES OF CONSCIOUSNESS, DROWSINESS, DISTRESS, AND PERFORMANCE

RELATED APPLICATIONS

The present application is a divisional application of Ser. No. 09/339,866, filed Jun. 25, 1999, now U.S. Pat. No. 6,265,978, which is a continuation-in-part of Ser. No. 08/891,445 filed Jul. 10, 1997, now U.S. Pat. No. 5,917,415.

FIELD AND BACKGROUND OF THE INVENTION

The present invention relates to a method and wrist-worn apparatus for monitoring states of consciousness, drowsiness, distress, and/or performance of a person, and particularly for the early detection of increasing drowsiness in a person in order to alert the person and possibly others in the near vicinity.

The state of increasing drowsiness is manifested by a number of physiological changes. The device implemented by this invention utilizes autonomic and/or central nervous system electro-physiological monitoring and/or automatic reaction time testing, for detecting the onset of drowsiness.

Recent 1998 statistics issued by the U.S. Department of Transportation revealed that drowsy drivers are the cause of some 60,000 accidents resulting in 45,000 injuries and 15,000 fatalities. This invention is thus particularly useful in safety and security applications. Examples of users in such applications include vehicle drivers, pilots, flight controllers, night shift workers and the military. The invention is thus applicable whenever drowsiness is to be detected to prevent accidents and particularly distinguishes from traditional methods that analyze brain waves, eye movements, steering wheel movements and other means described in the published literature.

This invention may also be used as an adjunct to monitoring in a sleep laboratory or at home, to in depth anesthesia monitoring, and to various diagnostic monitoring, particularly when a memory module is attached.

BRIEF SUMMARY OF THE INVENTION

An object of the present invention is to provide an improved method and apparatus for the physiological monitoring and alerting for events indicating increasing drowsiness, which method and apparatus do not require any sensors or electrodes (IR, EEG, EOG, etc.) to be affixed to a person's head, which makes the apparatus and method particularly useful in the above mentioned applications, as well as in a wide variety of other applications.

According to one aspect of the present invention, there is provided apparatus for detecting the onset of drowsiness in a person while gripping an object, particularly a vehicle driver gripping a vehicle steering wheel, comprising a wrist band to be worn by the person; an electrical sensor to be pressed by the wrist band, when worn by the person, into contact with the skin of the person for sensing a physiological condition thereat and for outputting electrical signals corresponding thereto; and a processor for processing the electrical signals and for producing an indication therefrom of the onset of drowsiness in the person.

According to further features in the preferred embodiments of the invention described below, the processor produces from the electrical signals a measurement of changes in muscular activity at the person's wrist, and utilizes such measurements in producing an indication of the onset of drowsiness in the person.

Several embodiments which are described below wherein the electrical sensor includes a plurality of electrodes for detecting electromyographic (EMG) electrical impulses produced by the person's wrist muscles which are processed by the processor for producing said measurements of muscular activity utilized in producing the indication of the onset of drowsiness.

According to further features in the described preferred embodiments, the electrical sensor further includes a thermistor for detecting changes in the skin temperature, which changes are also utilized in producing said indication of the onset of drowsiness in the person.

According to still further features in the described preferred embodiment, the electrical sensor also includes a vibro-tactile stimulator, and the processor also measures the reaction time from actuation of the stimulator to the response in the physiological condition, and utilizes the reaction time for producing an indication of the onset of drowsiness in the person.

According to another aspect of the present invention, there is provided an electrical sensor mountable in a shock-absorbing manner to an object for sensing a condition therein, particularly to the wrist of a person for sensing the onset of drowsiness, comprising: a first cup-shaped member of circular configuration including an annular rim extending outwardly from one side of the member for engaging with the object, a center region within the annular region, and an annular yieldable juncture joining said annular rim with the center region; a detector fixed to the center region within the rim and extending outwardly of the rim on one side of the cup-shaped member; and a band applied over the opposite side of the cup-shaped member to apply a force pressing the rim firmly against the object when mounted thereon, and also pressing, via the annular yieldable juncture, the detector firmly against the object.

According to still further aspect of the present invention, there is provided a method for detecting the onset of drowsiness in a person while gripping an object, particularly a vehicle driver while gripping a vehicle steering wheel, comprising: pressing an electrical sensor into contact with the skin of the person's wrist for sensing a physiological condition thereat and for outputting electrical signals corresponding thereto; and processing the electrical signals for producing an indication therefrom of the onset of drowsiness in the person.

A major advantage of the present invention is the absence of head-mounted electrodes and sensors. Particularly, brain waves and eye movements are traditionally measured with electrodes that require gels or pastes to be applied for making a good electrical contact, and further require mechanical or adhesive means for holding such electrodes in place. The minute EEG signals are prone to interfering signals arising from wire movements. Moreover, the application of the electrodes and lead wires to the scalp results in an unsightly appearance. In addition, EEG brainwaves signals are generally contaminated by EOG eye movement signals that act as interfering signals which have to be removed by special algorithms requiring substantial computer power before further EEG analysis of the brainwaves can be made.

The present invention, however, enables the monitoring device to be self-contained and to have no wires thereby enabling more conventional use and cleaner signals in hostile environments of radio frequency interference.

The parameters monitored are analog signals in nature. In the described preferred embodiments, they are amplified, filtered, and converted into a digital format for further processing by an embedded single chip computer. For each parameter an individualized baseline is computed and stored in a RAM memory. A trending is performed on each parameter. When the trended value divided by the baseline deviates from a preset percentage value stored in memory, a parameter alert flag is raised.

To transmit an overall alert flag, the device makes a decision based on majority of parameter alert flags being raised, on any single alert flag, or any desired combination of alert flags.

The first parameter alert flag identifies the violation of peripheral pulse rate variability preset. The pulse is sensed, amplified, filtered, converted from analog to digital and analyzed by the computer for beat-to-beat validity following software dicrotic notch detection. Extraneous pulses are rejected by the algorithm. The pulse rate variability is performed by spectral analysis of the beat-to-beat period. Increasing drowsiness is accompanied by decreasing pulse rate and variability thereof.

The second parameter alert flag identifies the violation of peripheral vasomotor response preset. The high-resolution skin temperature is sensed by a miniature bead thermistor, then amplified, filtered, converted from analog to digital and analyzed by the computer for peak-to-peak amplitude. Extraneous waveforms are rejected by the algorithm. Increasing drowsiness is accompanied by decreasing vasomotor tone variability due to the power sympathetic mediation.

The third parameter alert flag identifies the violation of muscle tone preset. The forearm EMG is detected by the wrist electrodes. The EMG signal is amplified, filtered, converted from analog to digital and analyzed by the computer following software rectification and integration for peak and average amplitudes. Increasing drowsiness is accompanied by decreasing muscle tone and muscle tone variability thereof.

The fourth parameter alert flag identifies the violation of peripheral blood flow presets. The limb's blood flow is sensed from the electrical impedance of the wrist band electrodes. The signal is amplified, filtered, detected, rectified and converted from analog to digital and levels are analyzed by the computer. Increasing drowsiness is accompanied by decreasing blood flow due to decreasing systolic blood pressure.

The fifth parameter alert flag identifies the violation of reaction time. Vibrotactile stimulation is automatically and periodically performed by a miniature concentric motor or any other suitable device. The above mentioned electrodes sense the skin potential response between any two points on the wrist. The skin potential response signal is amplified, filtered, polarity detected, and converted from analog to digital, and levels, polarity and delay following vibrotactile excitation are analyzed by the computer. Increasing drowsiness is accompanied by increasing reaction time as well as increasing tactile sensory and autonomic arousal thresholds.

The above mentioned electrodes and sensors are preferably dry (pasteless). Special means are provided by the present invention to assure shock absorption capabilities to sensors and electrodes, in order to enable reliable detection of minute signals with minimal mechanically-induced movement artifacts. Each shock absorber mechanically isolates a sensor or electrode with two independent suspensions, placing a constant pressure on the sensor or electrode which varies as a only one part in several hundreds as result of wrist movement and varying accelerations. The first order mechanical buffering is provided by a spring that suspends each sensor or electrode in an inverted cup that buffers the sensor or electrode from the surrounding skin. The second order mechanical buffering is provided by an air-cuff that closes around the wrist with Velcro type closure that further suspends the inverted cups.

A wireless communication link is preferably provided to a further remote apparatus that provides an audio-visual alert signal for the detection of increasing drowsiness. The remote apparatus may contain a clock and provide an optional periodic "rest" audio-visual reminder signals during the "red" hours when drowsiness may be at its peak. It further serves as a logger or recorder with PC download capability to record and identify the various flags by coding each one uniquely.

BRIEF DESCRIPTION OF THE DRAWINGS

FIG. 1 is a block diagram of the hardware components of one form of apparatus constructed in accordance with the invention;

FIG. 3 diagrammatically depicts the shock absorber provided for each sensor or electrode in the device of FIGS. 1 and 2;

DESCRIPTION OF PREFERRED EMBODIMENTS

Figure 2:
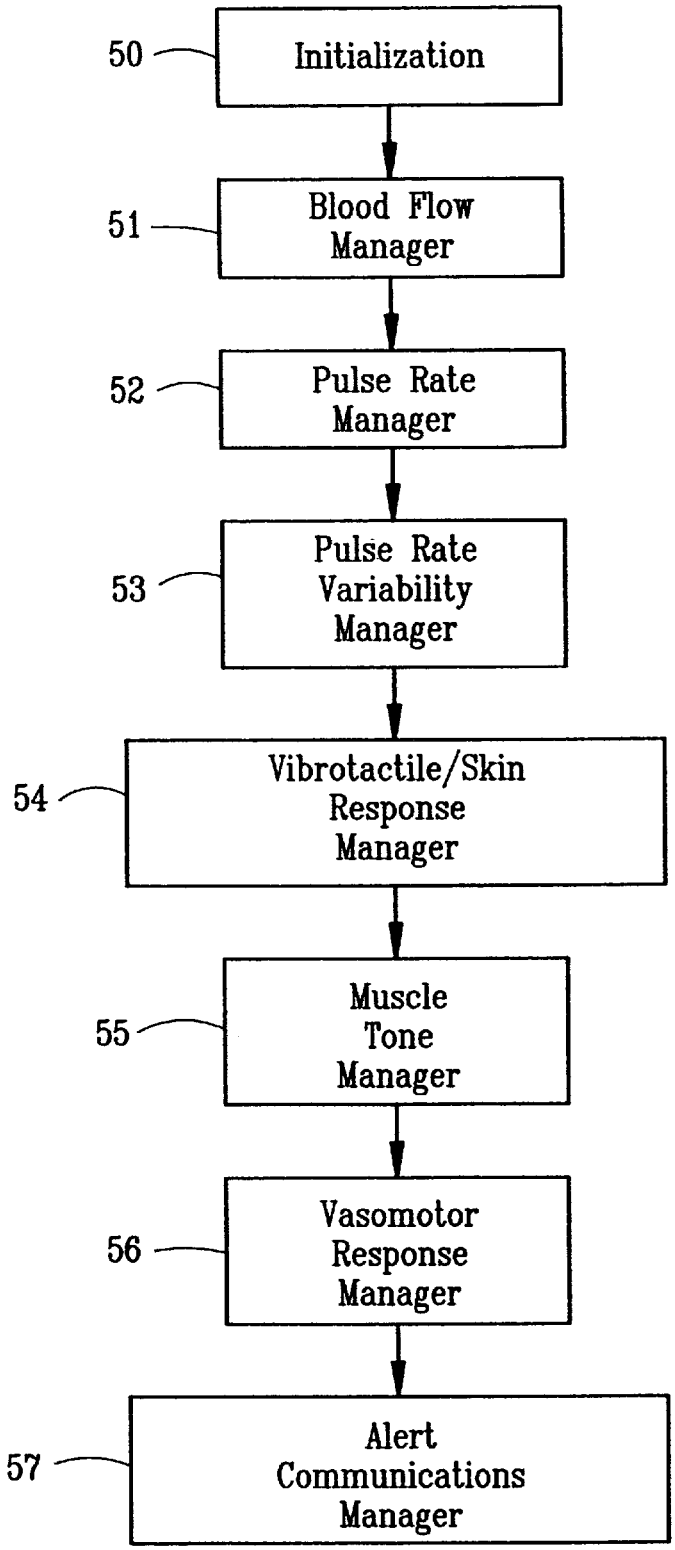
FIG. 2 is a block diagram of the software modules in the preferred embodiment of the apparatus of FIG. 1.
Figure 4:
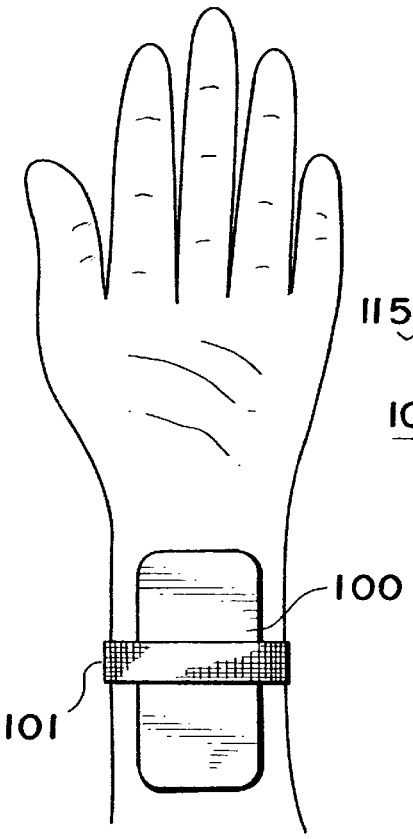
FIG. 4 illustrates the device of FIGS. 1–3 applied to the wrist of a person.

With reference to FIG. 1, there is illustrated a form of the device constructed in accordance with the invention as one preferred embodiment. The illustrated device contains a set of shock-absorbed sensors and electrodes 20 that measure the blood flow through electrical impedance, temperature through a miniature thermistor bead, pulse through a solid state sensor, EMG (muscle tension) and SPR (skin potential response) through electrodes.

The signals are amplified and filtered in a pre-amplifier and detector 21, and are then fed into anti-aliasing filters 22 before being converted into digital format by A/D converter 23. The digital signal processing is implemented by a single chip computer 24.

The computer generates the first parameter alert flag whenever it identifies the violation of peripheral pulse rate variability preset. The pulse is analyzed by the computer for beat-to-beat validity following software dicrotic notch detection. Extraneous pulses are rejected by the algorithm. The pulse rate variability is performed by spectral analysis of the beat-to-beat period.

The computer generates the second alert flag whenever it identifies the violation of the peripheral vasometer response preset. The high-resolution kin temperature is analyzed by the computer for peak-to peak amplitude. Extraneous waveforms are rejected by known algorithms.

The computer generates the third parameter alert flag whenever it identifies the violation of muscle tone preset. The forearm EMG, such as grip, is analyzed by the computer following software rectification and integration for peak and average amplitudes.

The computer generates the fourth parameter alert flag whenever it identifies the violation of peripheral blood flow presets. The limb's blood flow is sensed, in accordance with known techniques, from the electrical impedance of the wrist band electrodes. The signal is amplified, filtered, detected, rectified and converted from analog to digital and levels are analyzed by the computer.

The computer generates the fifth parameter alert flag whenever it identifies the violation of reaction time. Vibrotactile stimulation 25 is automatically and periodically performed by a miniature eccentric motor or other vibrator. The above-mentioned electrodes are periodically switched by a multiplexer 29 so as to sense the skin potential response SPR between any two points on the wrist. Levels, polarity and delay following vibrotactile excitation are analyzed by the computer.

With reference to FIG. 2, there is illustrated one form of the software flow in a device when constructed as a preferred embodiment of the invention. Following power-up, initialization 50 takes place. The blood flow manager 51 is responsible for conversion and analysis of blood flow. The pulse rate manager 52 is responsible for the pulse detection algorithms, pulse validation and artifact rejection. The pulse is further analyzed for spectral variability contents by the pulse-rate-variability manager 53. The reaction time measurement is provided for by the vibrotactile/skin response manager 54. Muscle manager 55 handles the EMG algorithms while vasomotor response manager 56 handles the surface thermometry. Finally, the alert communications manager 57 handles the wireless serial transmission by sending a general alarm flag and optionally a series of flags that identify each and every unique flag activated.

With reference to FIG. 3, there is diagrammatically illustrated one form of the device's shock-absorbers provided each electrode or sensor. The upper device surface 10 is where the wrist belt closes with Velcro type material. The electrode or sensor 12 is mechanically buffered inside an inverted cup housing 11. A first order shock absorbing spring or air cushion 13 is placed between the electrode or sensor and the inner top of the cup. The cup comes to rest on the skin at the lowest flange 14. A second order shock absorbing air cushion 15 is placed between the upper device surface and the outer top of the cup. Cable 16 connects the sensor or electrode in each such housing to the rest of the system.

FIGS. 4–9 illustrate various alternative construction of a wrist-mounted sensor that may be used in the above-described apparatus. The wrist-mounted sensor is generally designated 100 in FIG. 4, and is secured to the person's wrist strap or band 101.

Figure 5:
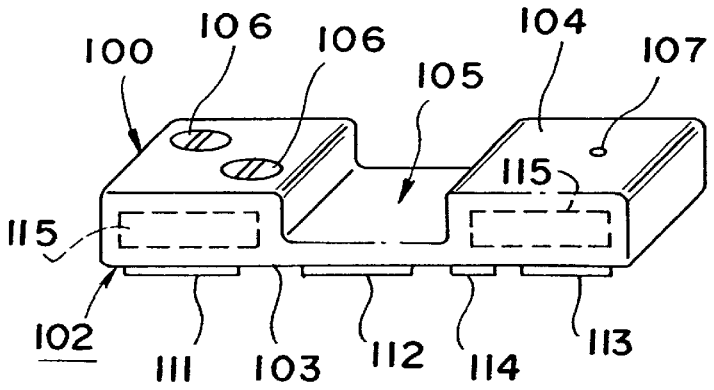
FIG. 5 is a three-dimensional view illustrating the electrical sensor device of FIG. 4.
Figure 6:
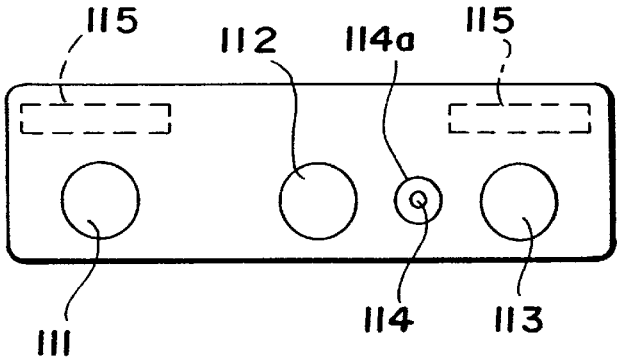
FIG. 6 is a bottom view illustrating the electrical sensor device of FIG. 5.

FIGS. 5 and 6 more particularly illustrate the construction of the wrist-mounted sensor 100. Thus, as shown in FIG. 5, it includes a flexible base member 102, e.g. of plastic, having an inner face 103 adapted to be brought into direct contact with the person's skin, and an outer face 104 adapted to be engaged by the watch band 101 for pressing inner face 103 against the person's skin. The outer face 104 of the base member is formed with a transversely extending groove 105 for receiving the wrist band 101. That face is also formed with openings 106 to two compartments for receiving batteries, and with an on-off push button switch 107 for energizing and de-energizing the sensor.

The opposite face 103 of the flexible band 102 carries the various detector elements for detecting certain physiological conditions of the wearer's wrist, as will be described more particularly below. In the embodiment illustrated in FIGS. 5 and 6, face 103 of the sensor includes two electrodes 111, 112, and a common electrode 113 for detecting electromyographic (EMG) electrical impulses produced by the wearer's wrist muscles. Such electrical impulses provide measurements of the changes in the muscular activity at the wearer's wrist, which measurements are useful in detecting drowsiness. Face 103 of the wrist sensor 100 further includes a thermistor 114, or other temperature measuring device, for detecting changes in the wearer's skin temperature due to vasomotor activity, e.g. to contraction and dilation of vessels; this information is also useful in determining the onset of drowsiness in the person.

Base member 102 of the wrist mounted sensor further includes a vibro-tactile stimulator 115. FIG. 5 illustrates two such stimulators 115 on opposite sides of the transverse groove 105. Such a stimulator may be, for example, a vibrator applying vibrations to the wearer's wrist in order to initiate a response. Thus, the reaction time between the actuation of the stimulus and the response is related to the degree of alertness of the person, and therefore may be used for providing an indication of the onset of the drowsiness or other similar condition.

The manner in which the three-electrodes wrist-sensor of FIGS. 5 and 6 is used for providing an indication of the onset of drowsiness is described below particularly with reference to the block diagram of FIG. 10.

Figure 7:
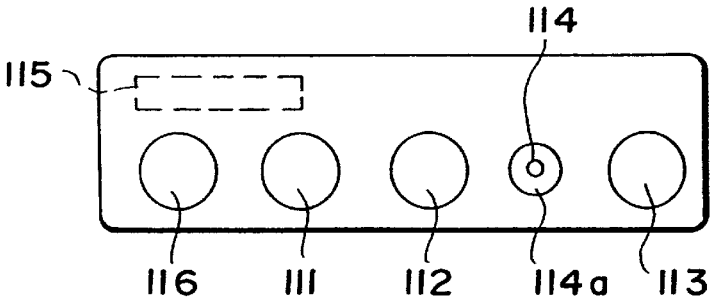
FIG. 7 is a bottom view illustrating a variation in the electrical sensor device.

FIG. 7 illustrates a four-electrode wrist-sensor. It is of the same construction as described above with respect to FIGS. 5 and 6 except that it includes a fourth electrode, shown as 116 in FIG. 7. The manner in which the four-electrode sensor of FIG. 7 is used for providing an indication of the onset of drowsiness is described below with respect to the block diagram of FIG. 11.

The wrist monitoring of muscle tonus variations by electrodes 111–113 (and 116 in FIG. 7) enables continuously testing the person's psychomotor vigilance. The person holding a steering wheel or any other object, or complying otherwise with the instruction to maintain a slight pressure with at least one of the fingers of the monitored wrist, creates a bias or baseline muscle tension from which an adaptive measure allows the person's "readiness to perform" to be tested by computing a measure of minimal effort or minimal work. This static isometric force decays during the onset of sleep or before. The transition of a time-integral average below a fixed or adaptive threshold may signal the initiation of a cautionary flag, initiating an immediate dynamic psychomotor vigilance test as described below.

The vibro-tactile stimulator 115 may be similar to that commonly found in pagers or cellular telephones. It serves as part of a scheme for dynamically testing the person's psychomotor vigilance via periodically initiated stimulations, or can immediately initiate stimulation upon sensing a suspected hypo-vigilance. By requiring the person to respond to periodic stimulation sensation with a momentary increase and release of grip, pinch or pressure with at least one of the fingers of the monitored wrist, the relative muscle tonus variation or grip muscle work is computed and compared with a baseline measurement. Hypo-vigilance is identified as particular fixed and/or adaptive work thresholds, which are not exceeded either in the static, continuous test or in the dynamic test, described above. The vibro-tactile transducer then further serves to alert the person that hypo-vigilance has been identified, by performing a pulsating more powerful stimulation.

The thermal information provided by thermistor 114 may be used in accordance with known algorithms to anticipate hypo-vigilance and sleep onset due to profound relaxation of the autonomic nervous system, before the central nervous system produces clear signs of sleepiness. As known, the high-resolution thermometry produces a measure of the vasomotor waves, which may be analyzed for pattern shifts from baseline, including spectral period and amplitude analysis, according to known techniques.

Figure 8:
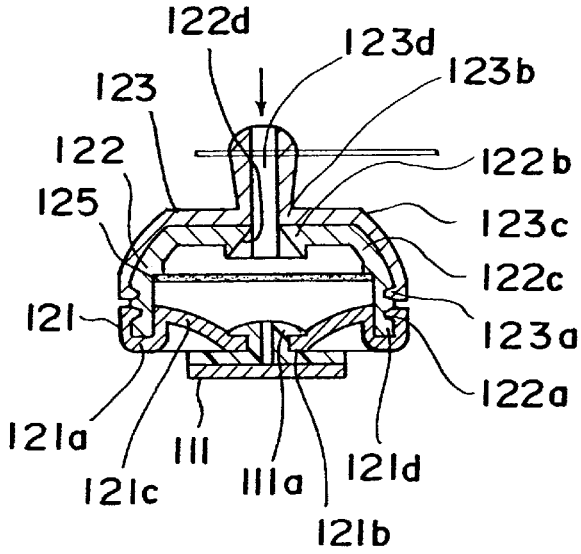
FIG. 8 is a sectional view illustrating the shock-absorbing mounting of one of the electrodes in the electrical sensor, FIG. 8*a* illustrating the sensor in operating position mounted on the person's wrist.
Figure 8A:
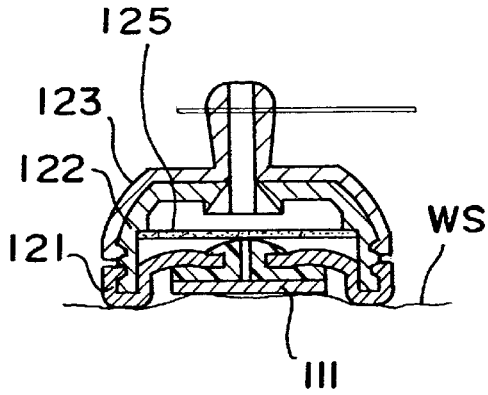
Figure 9:
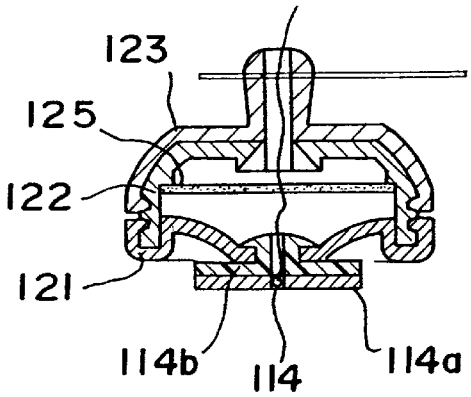
FIG. 9 is a view similar to that of FIG. 8 but illustrating the shock-absorbing mounting of a thermistor used in the electrical sensor.

FIGS. 8 and 8*a* illustrate one construction that may be used for mounting each of the electrodes 111–113 and 116 in a shock-absorbing manner to the base member 102 in order to maintain the constant pressure contact between the detector and the wearer's skin during the wrist movement; and FIG. 9 illustrates a similar construction for mounting the thermistor 114.

Thus, as shown in FIGS. 8 and 8*a*, the shock-absorbing mounting for the electrodes, e.g. 111, comprises three cup-shaped members of circular configuration, namely inner member 121 for mounting the electrode 111, intermediate member 122, and outer member 123.

The inner cup-shaped member 121 is formed with an annular rim 121*a* adapted to be pressed into firm contact with the wearer's skin WS, as shown in FIG. 8*a*. This member is further formed with a center region 121*b*, within the annular rim of member 121, and an annular yieldable juncture 121*c* joining the annular rim with the center region. The electrode 111, or other detector element, is fixed to the center region 121*b* by an enlarged head 111*a* formed in the electrode 111. Annular rim 121*a* is formed with an annular groove 121*d* facing the opposite side of the cup from the electrode 111 for attachment to the intermediate cup-shaped member 122.

The intermediate cup-shaped member 122 is also formed with an annular rim 122*a*, a central region 122*b*, and an annular juncture region 122*c* joining the rim to the central region. Annular rim 122*a* is received within annular groove 121*d* of the lower member 121 for supporting that member and also the electrode 111 attached to it.

The outer cup-shaped member 123 serves as a cover to enclose the intermediate member 122. It is therefore of a similar configuration, including an outer rim 123*a*, a central region 123*b* within the rim, and a juncture region 123*c*.

The center regions of the two cup-shaped members 122 and 123 are formed with aligned holes as shown in 122*d* and 123*d*, respectively, for receiving the electrical conductors making connections to the respective electrode 111.

In the embodiment illustrated in FIG. 8, the shock-absorbing mounting also includes a pre-amplifier circuit board 125 for amplifying the output of the electrode 111. This is an optional feature as the pre-amplification can be effected in the processor for processing the outputs of the electrodes.

FIG. 8 illustrates the condition of the shock-absorbing mounting before the electrode 111 is pressed into contact with the wrist. As shown in FIG. 8, the electrode 111 is yieldingly supported by the yielding juncture 121*c* of the innermost cup-shaped member 121 so that it projects outwardly of the mounting.

FIG. 8*a* illustrates the condition when the sensor is applied to the wrist, wherein it will be seen that the force of the wrist band 101 is applied to the outer annular rim 121*a* of the inner member 121, thereby pressing it into firm contact with the wearer's skin, and also displacing the electrode 111 so that it is firmly pressed against the wearer's skin by the yielding juncture 121*c*.

FIG. 9 illustrates the shock-absorbing mounting for the thermistor 114, wherein it will be seen that it also includes three cup-shaped members described above, and therefore correspondingly numbered to facilitate understanding. In this case, however, the inner cup-shaped member 121 mounts the thermistor 114, which is carried centrally of a heat conductor disc 114*a* on one side, and a heat insulator 114*b* at the opposite side to minimize the dissipation of the heat sensed by the thermistor.

Figure 10:
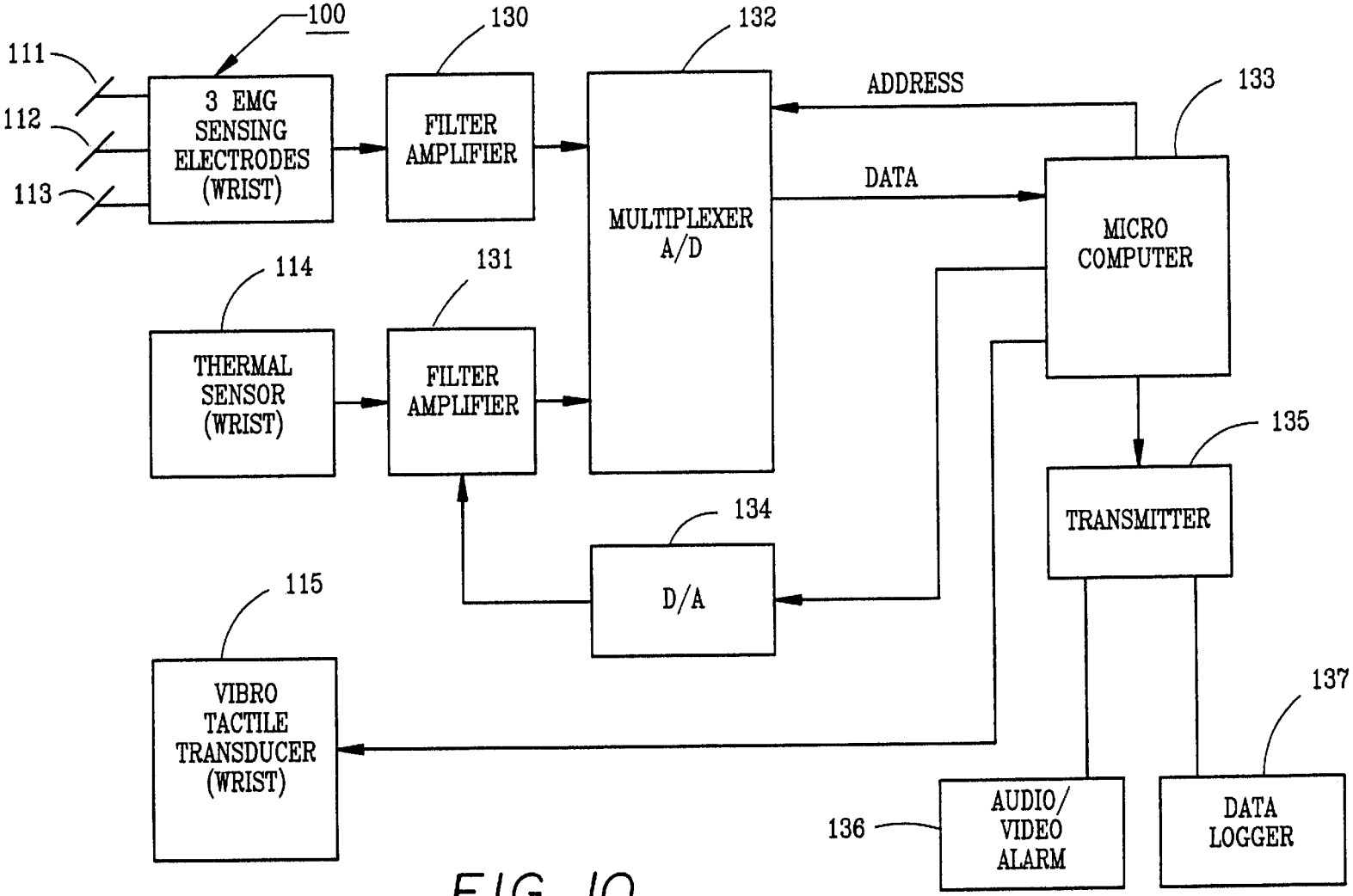
FIG. 10 is a block diagram illustrating the overall apparatus using the three-electrode sensor of FIGS. 5, 6, 8, 8*a*, and 9.

FIG. 10 is a block diagram illustrating the electrical system of FIGS. 5 and 6. Two of the electrodes 111, 112, are used for measuring, while the third 113 is used as the common electrode. These electrodes may be plated with gold or other bio-compatible material to create a galvanic array of dry (pasteless) bio-potential electrodes that sense the EMG electrical impulses accompanying activity of the muscles, which impulses may therefore be used for producing measurements of a muscular activity. Alternatively, the electrode array could be a capacitive array rather than a galvanic array, for reducing movement artifacts, in which case the electrodes could be aluminum discs that are coated with a hard anodizing layer (black).

The outputs of the electrode array 100 are filtered and amplified in block 130, converted into digital form, and multiplexed in block 132 to microcomputer 133.

The temperature information from the thermal sensor (thermistor) 114 is also filtered and amplified in block 131, converted to digital form and multiplexed in block 132, before also being fed to the microcomputer 133. The microcomputer includes a feedback via D/A converter 134 to the filter and amplifier 131, to enable this information to be used in producing a measure of the vasometer waves, by an output of pattern shifts from the base line, in accordance with known techniques.

Microcomputer 133 also produces an output to the vibro-tactile transducer 115 by periodically, or aperiodically, stimulating the person. This may be in the form of a stimulation applied to the person, requiring the person to respond with a momentary increase and/or decrease of the grip, pinch or pressure with at least one of the fingers of the monitored wrist. Microcomputer 133 measures the reaction time for producing this response, which information is also used by the microcomputer for producing an indication of the onset of drowsiness in the person.

The information processed by the microcomputer 133 is transmitted via a transmitter 135 wirelessly to a receiver, such as an audio/video alarm unit 136 mounted on the dash board , and/or a data logger 137 for producing a record of the monitored conditions expressed by the person.

Figure 11:
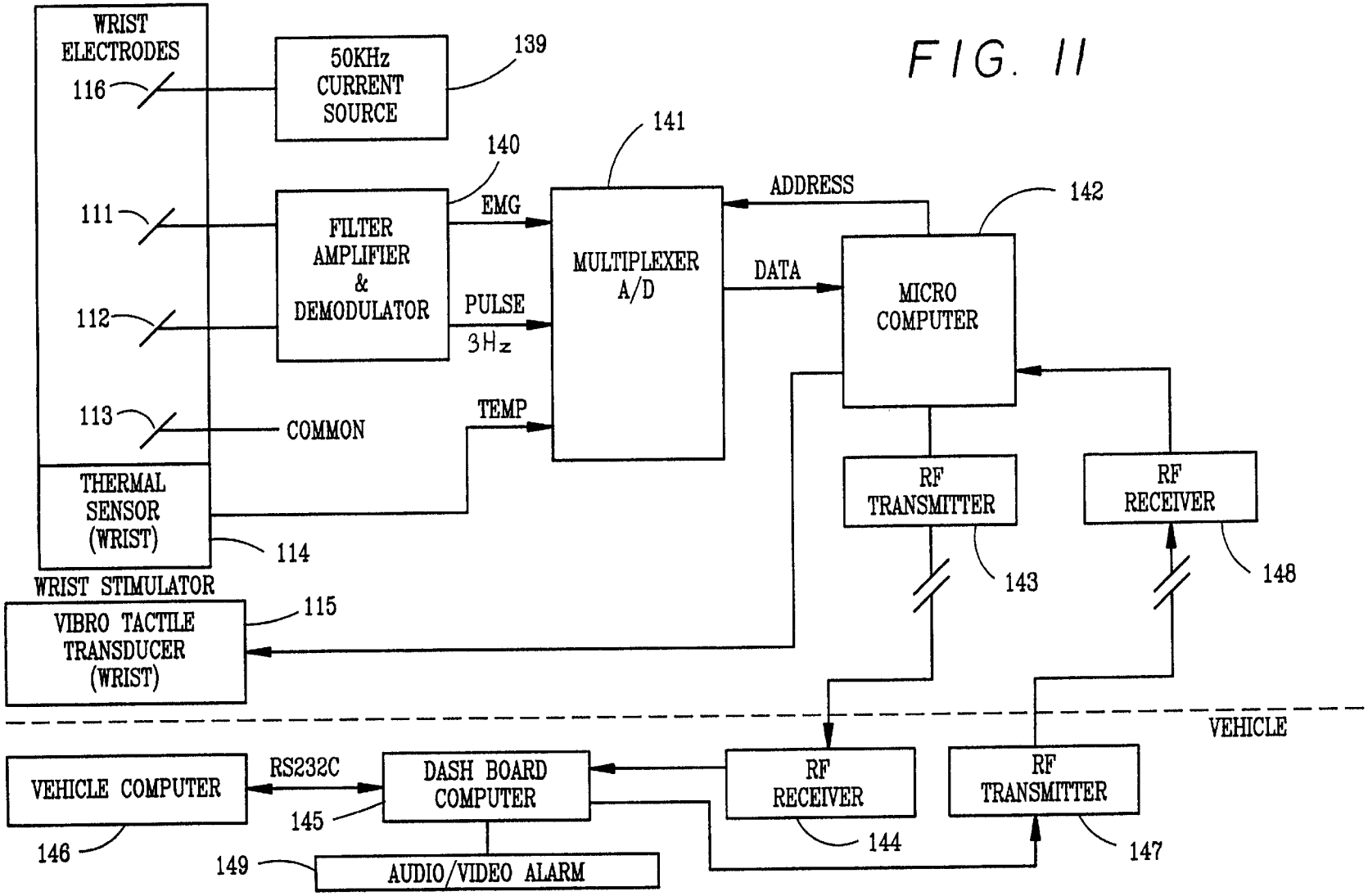
FIG. 11 is a block diagram of the overall apparatus using the four-electrode sensor of FIG. 7.
Figure 12:
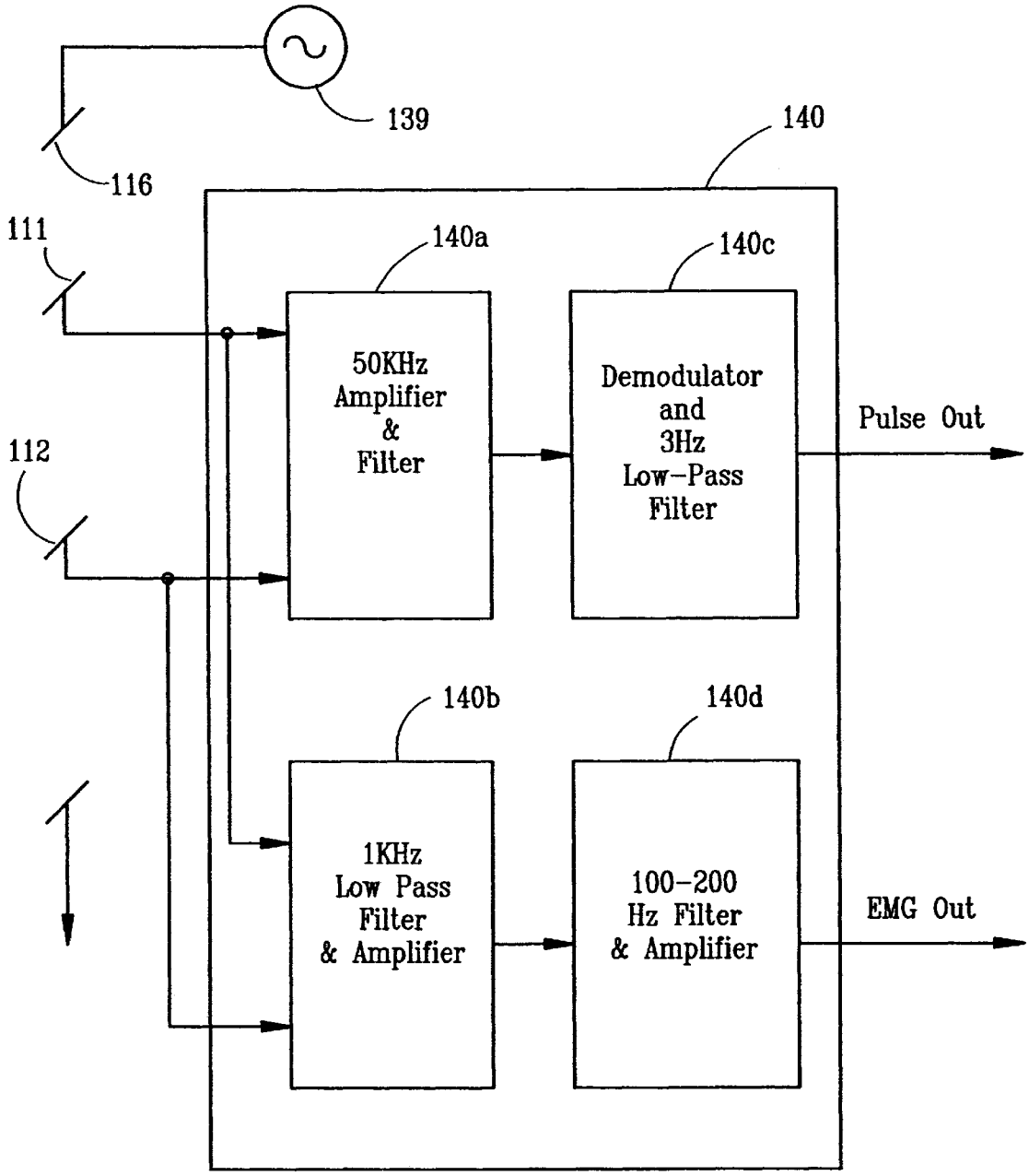
FIG. 12 is a block diagram illustrating the filter amplifier unit in the apparatus of FIG. 1.

FIG. 11 is a block diagram illustrating a system using the fourth-electrode sensor of FIG. 7 and including a fourth electrode 116. This fourth electrode is connected to a high frequency (e.g., 50 KHz) current source 139 for applying high frequency electrical pulses to the fourth electrode 116. The signals detected by electrodes 111, 112 are fed to a filter, amplifier and demodulator circuit 140, more particularly illustrated in FIG. 12. Thus, as shown in FIG. 12, the output of the two electrodes 111, 112, is fed to a 50 KHz filter and amplifier circuit 140*a* and also to a 1 KHz low pass filter and amplifier 140*b*. The output of circuit 140*a* is fed to a demodulator and 3 KHz low pass filter circuit 140*c*, to produce an output corresponding to the blood pressure pulses of the person; whereas the output of circuit 140*b* is fed to a 100–200 Hz filter and amplifier circuit 140*d* to produce an output representing the EMG of the person, both in accordance with known techniques.

The above two outputs of filter/amplifier circuit 140 are converted to digital form and multiplexed in circuit 141 before being fed to microcomputer 142, which processes the information and feeds it to an RF transmitter 143.

As shown in FIG. 11, the foregoing elements are included in the wrist unit mounted on the person. If the person being monitored is the driver of a vehicle, the vehicle could be equipped with an RF receiver 144 connected to a dash board computer 145 in communication with the vehicle computer 146. That vehicle could also be equipped with an RF transmitter 147 connected to a dash board computer 145 for transmitting data to an RF receiver 148, included within the wrist unit for controlling the microcomputer 142 of that unit. The dash board computer 145 could also control an audio/video alarm 149 to alert the driver, or any other passenger, of the onset of drowsiness if and when that is determined to be present by the monitoring system.

Figure 13:
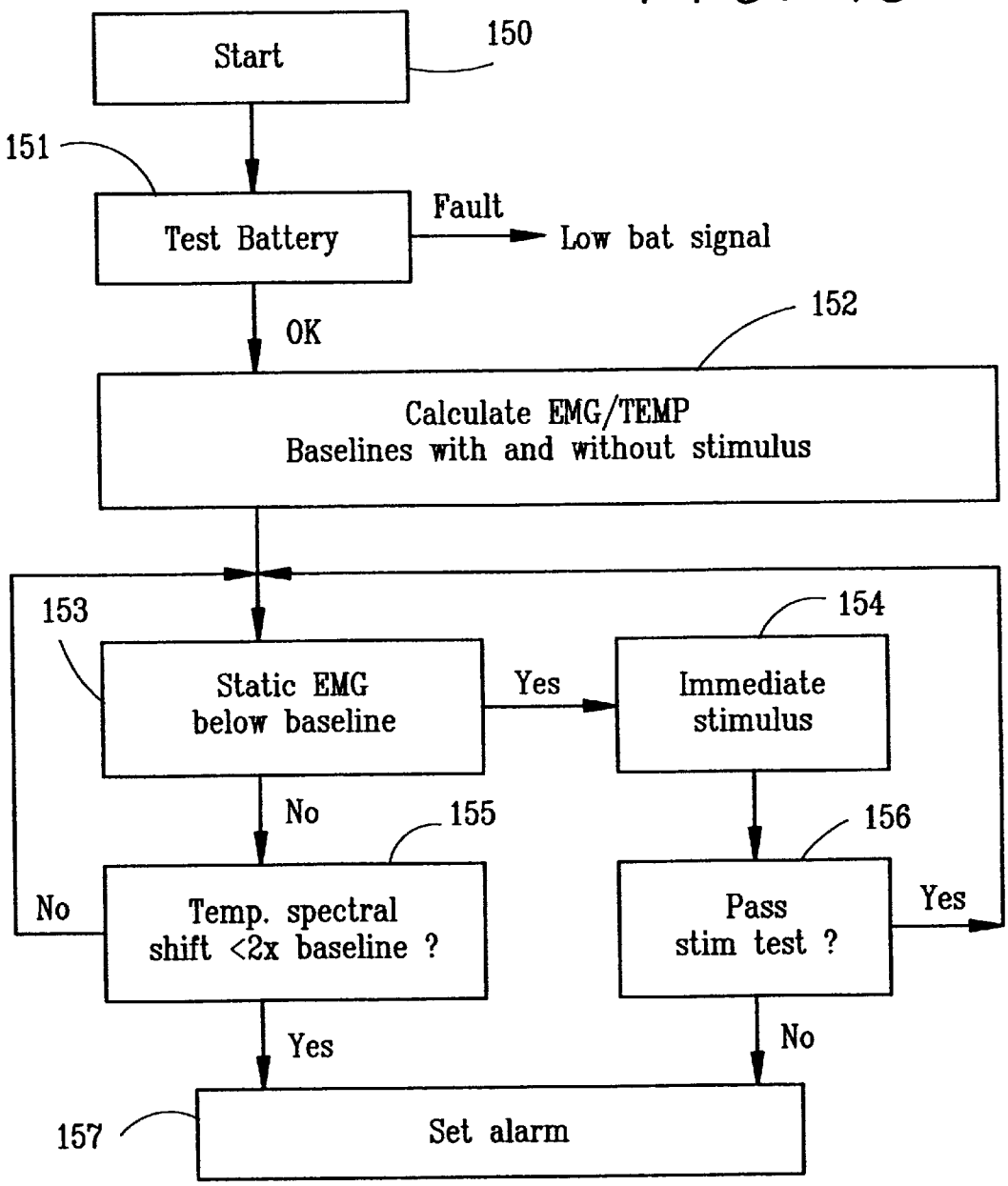
FIG. 13 is a flow chart illustrating the operation of the apparatus.

FIG. 13 is a simplified flow chart illustrating the operation of the three-electrode sensor system shown in FIG. 10. Thus, upon the start (block 150) the battery is tested (block 151), and if found satisfactory, the computer calculates the EMG/temperature base line with and without the vibro-detector stimulus by stimulator 115 (block 152). This base line is used as a reference for determining whether sufficient changes have occurred from that base line to indicate the onset of drowsiness.

Thus, if the EMG detection falls below the base line (block 153) an immediate stimulus is applied by the stimulator 115 (block 154), and the reaction time is measured. This information is used together with the other information to determine whether the person has passed the drowsiness test (block 156). If the test is not passed, i.e., the onset of drowsiness is indicated, the alarm is set (block 157), to alert the person and/or passengers in the vehicle.

The alarm may also set by the test performed in block 155, namely by the skin temperature measurements by the thermal sensor 114, when that process according to known algorithms as shown in block 155, indicates the onset of drowsiness.

The methods, apparatus and systems described above may thus be used for monitoring states of consciousness, drowsiness, distress and/or performance in a large number of applications, including:

1. Identifying the propensity to sleep, subtle incapacitation, drowsiness and the onset of sleep, alerting and invoking alertness assurance strategies (particularly applicable in critically vigilance-intensive tasks, including drivers, pilots, air traffic controllers);
2. Identifying sleep onset and delaying the entry into deeper sleep, alerting and involving alertness assurance strategies (particularly applicable in moderately vigilance-intensive task monitoring, including shift workers, train engineers, guards);
3. Identifying sleep-onset, recording sleep latency and duration, and correlating with sleep apnea breathing cessation (particularly applicable in sleep monitoring);
4. Identifying loss-of-consciousness and other forms of sudden incapacitation, recording and alerting (particularly applicable for drivers, pilots, firemen and the elderly);
5. Identifying and recording vigilance deterioration (particularly applicable in alertness assurance studies);
6. Identifying stress due to pain or anxiety (particularly applicable in dental procedures); and
7. Identifying needed motor skills to improve hand coordination performance (particularly applicable in playing golf, tennis, baseball). In this embodiment, dual wrist band monitors may be employed to compare the grip on both hands to a baseline, as well as to each other.

Thus, there has been described a wrist monitor to monitor performance, incapacitation and motor skills. The device is worn on the wrist whose function is to sense gradual performance impairment or subtle incapacitation, such as imminent falling asleep due to increasing fatigue and drowsiness, or sudden incapacitation due to heart attack, loss of consciousness, micro-sleep or actual sleep.

The monitor measures and processes myro-motor, vasomotor and psycho-motor vigilance variables, and expert system algorithms provide the decision on alarm activation. The device's vibro-tactile stimulator, auditory or visual cue enables vigilance testing in pre-programmed intervals by requiring a pre-selected pattern in response to a preselected stimulation cue pattern. Upon the person's failure to respond, the alarm can be generated in the form of auditory, visual, remote wireless, tactile, or any combination of the above.

In an alternative embodiment of the device, where soldier's or worker's sudden incapacitation or actual falling asleep need to be monitored, the device contains a pressure-sensing disk or pad, which in its simplest form is a force-sensitive resistor, held between the two fingers or lightly pressed upon with one finger. An amplifier amplifies the pressure signal and converts it to a digital baseline signal which is stored in the device's microcomputer memory. Upon loss of isometric pressure below a baseline for a selected period of time, the device either generates an alarm for further tests of the person's state by requiring a momentarily increased pressure by a single finger press or two-finger pinch, serving as a psychomotor vigilance test. Upon the person's failure to respond, the alarm is generated.

Other alternatives include comparing spectral shift of myro-motor activity between 30–200 Hz with respect to a baseline to enable detection of increasing drowsiness. Differentiating between sleep and loss of consciousness by comparing the spectral shift of vasomotor activity can also be detected. The alarm signal can be transmitted to a remote location, or recorded for legal or insurance proceedings. A monitor on the dashboard may also be configured to advise the driver of his alertness level. The automobile may be configured to disengage cruise control, apply the brakes or take other safety measures when drowsiness is detected. The alert can be in the form of a mild discomfort level to induce artificial insomnia.

Although the invention has been described in detail for the purpose of illustration, it is to be understood and appreciated that such detail is solely and purely for the purpose of example, and that many other variations, modifications and applications of the invention can be made by those skilled in the art without departing from the spirit and scope of the invention.

What is claimed is:

1. An electrical sensor mountable in a shock-absorbing manner to an object, comprising:

a first cup-shaped member of circular configuration including an annular rim extending outwardly from one side of the member for engaging with the object, a center region within said annular region, and an annular yieldable juncture joining said annular rim with said center region;

a detector fixed to said center region within said rim and extending outwardly of said rim on one side of the cup-shaped member; and a band applied over the opposite side of the cup-shaped member to apply a force pressing said rim firmly against said object when mounted thereto, and also pressing, via said annular yieldable juncture, said detector firmly against the object.

2. The sensor according to claim 1, wherein said shock-absorbing sensor further comprises: a second cup-shaped member including an annular rim for coupling to the annular rim the first cup-shaped member at said opposite side thereof, a center region to receive said force applied by the band when worn by the user, and an annular juncture joining the annular rim of the second cup-shaped member to said center region thereof.

3. The sensor according to claim 2, wherein said first cup-shaped member is formed with an annular recess around its rim facing in a direction opposite to said object, the annular rim of said second cup-shaped member being received in said annular recess for coupling the annular rim of the second cup-shaped member to the outer rim of the first cup-shaped member.

4. The sensor according to claim 3, wherein said shock-absorbing mounting further comprises a third cup-shaped member overlying said second cup-shaped member and serving as a cover therefor.

5. The sensor according to claim 4, wherein said electrical detector outputs its electrical signals via an electrical conductor passing through openings in said center regions of said second and said third cup-shaped members.

6. The sensor according to claim 3, wherein a pre-amplifier circuit element is secured between said first and second cup-shaped members and connected to said electrical detector.

7. The sensor according to claim 1, wherein said detector detects EMG impulses.

8. The sensor according to claim 1, wherein said detector detects skin temperature.

* * * * *